US005456378A

United States Patent [19]

DeMars

[11] Patent Number: 5,456,378

[45] Date of Patent: Oct. 10, 1995

[54] CONTAINER OPENING APPARATUS

[76] Inventor: Robert A. DeMars, 23221 Ladrillo Ave., Woodland Hills, Calif. 91367

[21] Appl. No.: 224,703

[22] Filed: Apr. 8, 1994

Related U.S. Application Data

[63] Continuation-in-part of Ser. No. 87,128, Jul. 1, 1993, abandoned.

[51] Int. Cl.[6] ..... B65D 17/34

[52] U.S. Cl. ..... 220/269

[58] Field of Search ..... 220/269, 270, 220/271, 272, 273, 276

[56] References Cited

U.S. PATENT DOCUMENTS

| | | | |
|---|---|---|---|
| 3,250,425 | 5/1966 | Stec et al. | 220/269 X |
| 4,320,850 | 3/1982 | Drolen, Jr. | 220/269 |
| 4,402,421 | 9/1983 | Ruemer, Jr. | 220/269 |
| 4,465,204 | 8/1984 | Kaminski et al. | 220/269 |
| 4,951,835 | 8/1990 | DeMars et al. | 220/269 |
| 5,131,555 | 7/1992 | DeMars et al. | 220/269 |
| 5,224,618 | 7/1993 | Garbiso | 220/269 |
| 5,248,053 | 9/1953 | Lundgren | 220/269 |

*Primary Examiner*—Allan N. Shoap
*Assistant Examiner*—Stephen Cronin
*Attorney, Agent, or Firm*—Jack C. Munro

[57] ABSTRACT

An opening tab for a closure wall of a container, such as a beverage container, where the opening tab is to be movable in a plane perpendicular to the surface of the closure wall to affect consistent breaking of a frangible seal and deflecting of a panel formed within the closure wall, creating an access opening permitting dispensing of the contents of the container wherein the opening tab is to be stored other than in the 6 o'clock position and is to be movable sideways along the surface of the closure wall from a storage position to an elevated 6 o'clock frangible seal breaking position. Operating of the opening tab inadvertently in either the storage position or the frangible seal breaking position and any position there between will result in consistent breaking of the frangible seal, deflecting of the panel, and creating the access opening.

9 Claims, 2 Drawing Sheets

CONTAINER OPENING APPARATUS

REFERENCE TO PRIOR APPLICATION

This application is a continuation-in-part of patent application Ser. No. 08/087,128, filed Jul. 1, 1993 now abandoned by the same title and same inventors.

BACKGROUND OF THE INVENTION

1. Field of the Invention

The field of this invention relates to containers which are commonly referred to as beverage cans, and more particularly to an aluminum type of beverage container which has integrally incorporated within the top closure wall of the container an opening device which frangibly separates a panel from the remaining portion of the top closure wall thereby producing an access opening through which the contents of the beverage container can be removed.

2. Description of Prior Art

Beverage container opening devices that utilize a frangible seal have long been known. The most commonly used construction of frangible seal is shown by U.S. Pat. No. 4,402,421 issued to a John Ruemer, Jr., issued Sep. 6, 1983. A very basic patent in opening devices was issued to a F. J. Stec et al., U.S. Pat. No. 3,250,425 issued May 10, 1966. The present inventor has also acquired a couple of patents in the same field, U.S. Pat. No. 4,951,835, issued Aug. 28, 1990 and U.S. Pat. No. 5,131,555, issued Jul. 21, 1992.

These beverage container opening apparatuses of the prior art all utilize a frangible panel within the lid of the beverage container. A handle is pivotally mounted on the lid and is to be movable within a plane perpendicular to the lid to cause breakage of the frangible seal between the panel and the lid to cause the panel to deflect inwardly into the interior of the beverage can exposing an access opening through which the contents of the beverage can be dispensed or in Stec, et al. the panel is removed outwardly.

The physical size of the beverage can is such that the free outer end of the handle is located directly adjacent the edge of the lid. These handles are mounted directly flush against the lid. It is difficult for most humans to use one's hand to initiate the upward pivoting of the handle from its flush position against the lid so that the handle can be moved to affect frangibly breaking of the panel from the remaining portion of the lid. As previously discussed in relation to the aforementioned patents, women commonly use their fingernails to lift and move the handle of the opening tab which results in nails being broken. Men generally do not have much of a fingernail and find it difficult to get the handle initially moved to affect the frangible separating from the lid.

In the past tools have been designed which are to engage the handle so that the handle can be initially lifted to a position which makes it easy for one to move the handle the remaining distance to frangibly separate the panel from the lid. However, these tools would require an additional piece of equipment that must be carried by an individual and if forgotten by an individual, no tool is available.

Within the prior art it is known to include some type of mechanism associated with the handle of the opening tab to facilitate the movement of the handle without the use of any tool. The aforementioned patents to the present inventor and the patent to Stec et al. clearly show and describe such devices. The basic concept of such devices is that the handle is to be movable first in a direction along the plane of the lid from a storage position to a usage position. During this movement the handle will rise up an inclined protuberance so that the outer free end of the handle becomes spaced from the surface of the lid. This spacing permits the easy location of a user's finger between the outer free end of the handle and the lid which then facilitates movement of the handle in a plane perpendicular to the lid to cause frangible separating of a scored panel from the lid.

However, within the patent to Stec et al., the handle must be moved to precisely the 6 o'clock position in order to provide for the removing of the pull tab. Also, within the aforementioned patents to DeMars and the patent to Ruemer Jr., the handle must be located at precisely the 6 o'clock position in order to achieve the desired frangibly separating of the panel from the lid.

It is desirable within the beverage industry to construct a beverage can opening device to be as foolproof as possible. The 6 o'clock position assures successful opening. However, with the desire to achieve easier lifting of the handle of the beverage opening device, storage of the handle away from the 6 o'clock position is proposed. Not every individual is going to understand, even in spite of specific instructions, that it is necessary to first pivot the handle from the storage position to a frangible seal breaking position prior to moving of the handle in the vertical plane in order to affect the separating of the panel along the frangible seal. Some individuals will merely, even though it is more difficult, directly begin to move the handle upward in a vertical plane without first moving the handle along the surface of the lid from the storage position to the frangible seal breaking position. In such an instance, when an individual eliminates the step of moving the handle from the storage position to the frangible seal position, it is desired by the beverage industry that the frangible seal still be broken. Companies which sell beverage products which include such a new opening method want to eliminate the chance of failure to be eliminated of the opening device if at all possible. Even if the device is misused, it is desirable to have the beverage container to be opened.

Within the prior art, if the handle is not located in almost precisely the 6 o'clock position and is lifted perpendicular to the lid, the breaking of the frangible seal will not occur. This definitely is an annoyance to most people even though the handle is not being operated in the manner in which it is intended to be used.

SUMMARY OF THE INVENTION

The structure of the present invention has to do with including an opening device in conjunction with a thin, generally metallic, sheet material, closure wall of a container such as a beverage container. Included within that wall, which can be generally defined as a lid, is a panel with the shape of the panel being defined by a frangible score line surrounding the periphery of the panel. The frangible score line is of a particular configuration and includes a gap area so the score line is not continuous and is not totally encircling. In observing the exterior surface of the lid, the slightly pointed portion of the panel that is located nearest the edge of the lid is defined as the 12 o'clock position and the portion of the panel that is located nearest the center of the lid is defined as the 6 o'clock position. The gap area of the score line is generally located at the 5 o'clock position. Mounted on the lid directly adjacent the 6 o'clock position of the panel is a small post upon which is mounted an opening tab.

This opening tab has an outer end and an inner end. The inner end is designed to come into physical contact with the panel for the opening operation with the outer end being designed to function as a handle to be used by a human to move the handle in a plane perpendicular to the surface of the lid so that the inner end of the handle, defined as the lever, applies physical pressure against the panel and causes the panel to physically separate along the frangible seal from the lid, initial opening occurring between the 9 to 11 o'clock positions, and hinge about the gap in a direction into the beverage container. The longitudinal center axis of the handle is recommended to be located in alignment between the 12 o'clock and the 6 o'clock position of the panel in order to affect the breaking of the frangible seal. In this position the handle will also be in an inclined position relative to the lid facilitating this opening movement of the handle. This handle is also capable of being located in a storage position with this storage position being generally from 4 to 5 o'clock relative to the panel. Opening operation of the panel is not intended when the handle is in the storage position. However, if the user lift to move the handle while still in the storage position and in a plane perpendicular to the lid, this movement will result in the frangible seal being broken and the panel deflecting producing the access opening. The reason for this is that the pressure applied by the lever is applied approximately at the 7 o'clock position of the frangible seal. The pressure is spaced away from the gap area where there is no frangible seal. However, if the pressure was applied in the area of the gap, which would occur if the lever was located at the 5 o'clock position, there will be inconsistent breaking of the frangible seal. Therefore, it is important to insure that even when the handle is misused that the pressure of the misuse will be applied to an area of the panel where there exists a frangible seal and that the frangible seal will be broken.

DETAILED DESCRIPTION OF THE SHOWN EMBODIMENT

Figure 2:
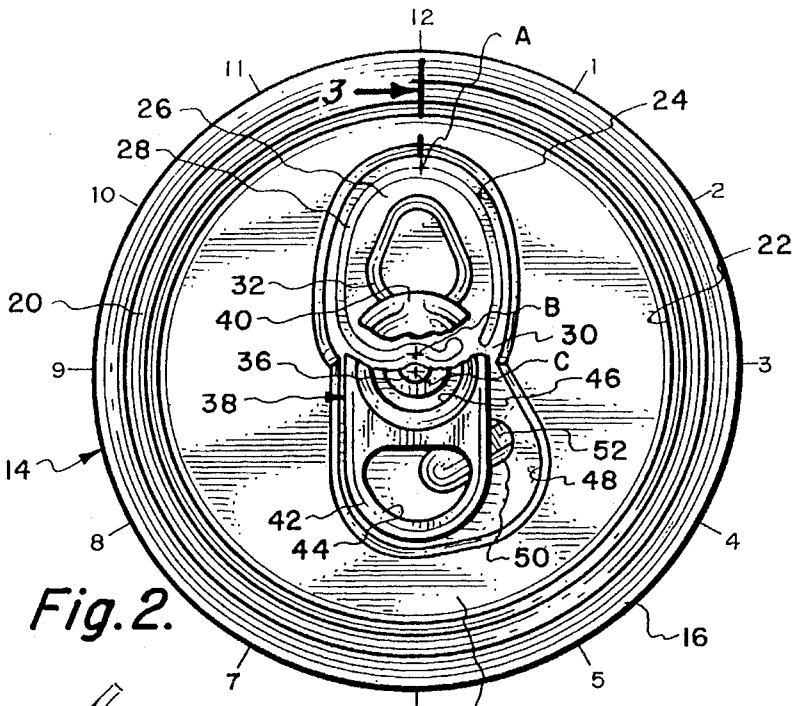
FIG. 2 is a view similar to FIG. 1 but showing the opening apparatus in its most desirable position of 6 o'clock to affect breaking of the frangible seal and producing of the access opening within the lid of the container.

Referring particularly to the drawing there is shown a sheet material, generally metallic, wall 10 of a beverage container which is designed to contain a quantity of a beverage within its internal compartment 12. The internal compartment 12 is designed to be closed at one end thereof by a lid 14. The lid 14 has an annular deformable edge 16 which is to be tightly crimped the end edge of the wall 10 thereby tightly closing of the internal chamber 12 relative to the ambient and prevent leakage of any of the contents contained within internal compartment 12 at the edge 16 and also prevent air from entering into the internal compartment 12.

This lid 14 includes a closure wall 18 which is enclosed by the edge 16. Connecting the edge 16 to the closure wall 18 is an annular inclined wall 20. The annular inclined wall 20 encloses a space 22 with the closure wall 18 defining the bottom wall of the space 22.

The closure wall 18 includes a panel depression 24. The panel depression 24 has a bottom wall which is defined as panel 26. Around the periphery of the panel 26 there is formed a score line 28. The portion of the score line 28 that is located nearest the edge 16 is defined as point A. Score line 28 almost completely encloses the panel 26 with the exception of a gap 30. Score line 28 creates a frangible seal and when sufficient pressure is applied appropriately and directly onto the panel 26, the panel 26 is designed to, and will, actually initially physically separate from the closure wall 18 at the 9 to 11 o'clock panel position and then continue around the entire length of the frangible seal thereby forming an access opening within the closure wall 18. It is through this access opening that the liquid contents contained within the internal compartment 12 is to be dispensed.

Figure 6:
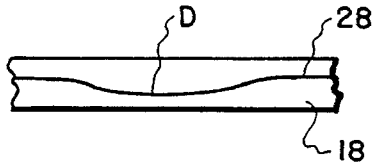
FIG. 6 is a cross-sectional view taken along line 6—6 of FIG. 4.

The panel 26 includes an enclosing raised rib 32. It is the function of the raised rib 32 to strengthen the panel 26. Score line 28 is actually a pair of closely spaced parallel score lines with breakage of the seal 28 to begin at point D on the outermost score line. Point D is scored deeper than the rest of the score line 28 as is shown in FIG. 6. When pressure is applied to the panel 26 by lever 40, the initial break occurs at point D. The location of point D is designed to be somewhat diametrically opposite gap 30 which is to function as a hinge during the opening operation. This hinge is to support the deflected panel 26 preventing complete separation from the closure wall 18. The most consistent opening operation results when tearing occurs over substantially the same distance in each direction away from point D. By locating point D 180° opposite gap 30 relative to a center line 29 through panel 26, this same tearing distance is achieved. This tearing distance is from 11 o'clock (point D) clockwise to about 4 o'clock and then counterclockwise from 11 o'clock to 4:30 o'clock.

Integrally formed within the main body section 18 and at the approximate center of the lid 14 is a post 34. Post 34 includes an enlarged head 36. Typically the post 34 will comprise a conventional rivet. The center point of the post 34 is defined as point C. The portion of the score line 28 that is located nearest the post 34 is defined as point B. Points A, B and C are on a single line which is conducted through the 12 o'clock to the 6 o'clock position of the lid 14. The line 3—3 in FIG. 2 coincides with this line that passes through points A, B and C. In both FIGS. 1 and 2 of the drawings, surrounding the periphery of the lid 14 is indicia representing hour designations of a clock. These hour designations are shown only to facilitate description and are not part of this invention.

Pivotally mounted on the post 34 is a handle 38. Handle 38 is integral with the lever 40 previously mentioned. Handle 38 also includes an outer end 42. The outer end 42 includes an enlarged opening 44. Located between the enlarged opening 44 and the point C is a half-circular slot 46. Handle 38 and lever 40 define the opening tab.

The handle 38 rests within an enlarged depression 48 formed within the closure wall 18. Fixedly located on the bottom wall of the main depression 48 is a protuberance 50. Protuberance 50 includes a camming surface 52 which terminates at a ledge 54.

Figure 1:
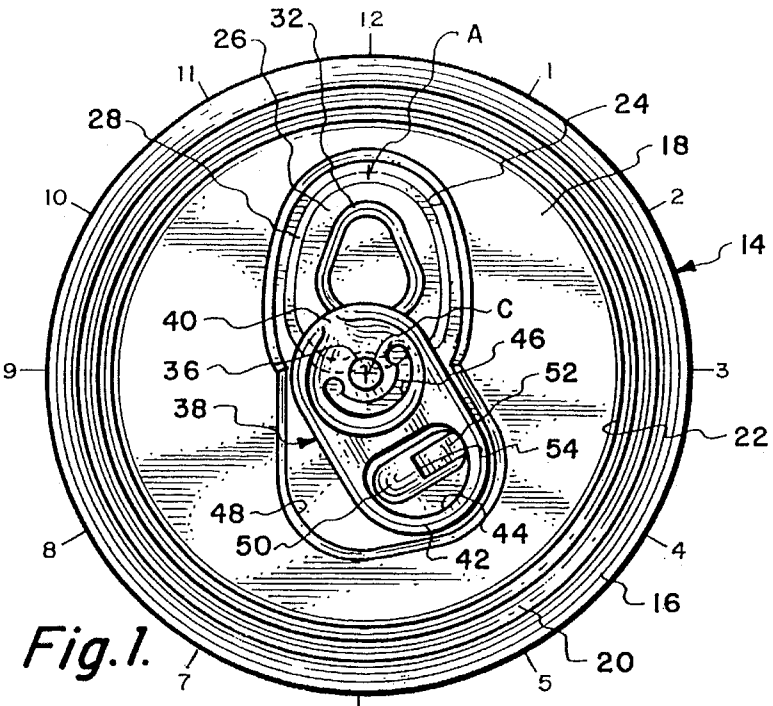
FIG. 1 is a top plan view of the closure wall opening apparatus of the present invention showing the opening apparatus in the storage position.
Figure 3:
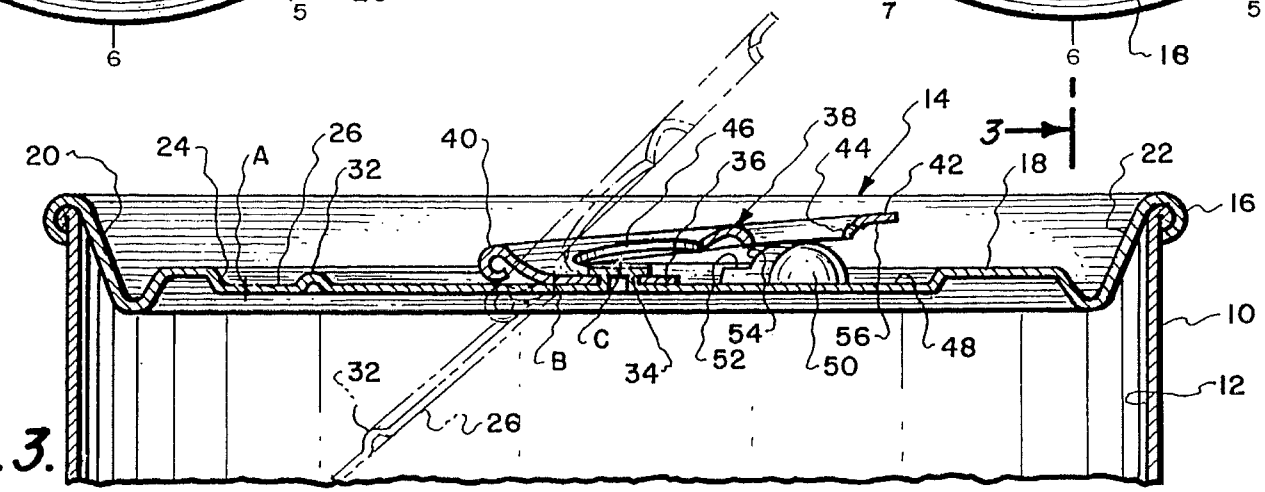
FIG. 3 is a cross-sectional view taken along line 3—3 of FIG. 2.

In this invention, normally the handle 38 will be located at approximately the 5 o'clock position as is shown in FIG. 1. In this position the protuberance 50 is located within the confines of the enlarged opening 44 which precisely defines the storage position of the handle 38. The normally intended operation is for a human to apply sideways pressure onto the handle 38 which moves a side edge of the handle 38 up onto the camming surface 52 and this continues until this edge comes up against ledge 54. This will then define the handle 38 in the 6 o'clock position as is shown in FIG. 2. The handle 38 will also assume an inclined position as is depicted in FIG. 3 which facilitates the location of a human finger to the undersurface 56 of the outer end 42 of the handle 38. This facilitates movement of the outer end 42 in an upward direction directly away from the closure wall 18 of the lid 14. When doing so the lever 40 applies pressure against the panel 26 which will cause the score line 28 to tear, starting in the area of nine to eleven o'clock thereby frangibly separating the panel 26 relative to the closure wall 18. Continual movement of the handle 38 as depicted in phantom lines in FIG. 3 will result in the panel 26 deflecting within the internal compartment 12 as is also shown in phantom lines within FIG. 3, thereby producing an access opening within the lid 14 through which liquid contents contained within the internal compartment 12 can now be dispensed.

However, not everyone will initially move the handle 38 sideways from the storage position shown in FIG. 1 to the desired (6 o'clock) usage position shown in FIG. 2. No matter how difficult it is, certain individuals will inadvertently or overtly directly move the outer end 42 of the handle 38 away from the closure wall 18, even when it is in the storage position in FIG. 1. When this occurs pressure will be applied by the lever 40 to the panel 26 with this pressure being in an area defined by the encircling score line 28. Therefore, breaking of the frangible seal will occur which is created by the score line 28. As the handle 38 is continued to move, complete separating of the panel 26 relative to the closure wall 18 will occur, except for the gap 30, producing the access opening.

If the handle 38 was located at the 7 o'clock position and the opening operation duplicated, without moving sideways of the handle 38, the pressure will be applied in the area of the gap 30. The gap 30 does not constitute any part of the score line 28. Therefore, breaking of the frangible seal does not consistently occur. It is the function of the gap 30 to function as a hinge for the deflecting movement of the panel 26.

Figure 4:
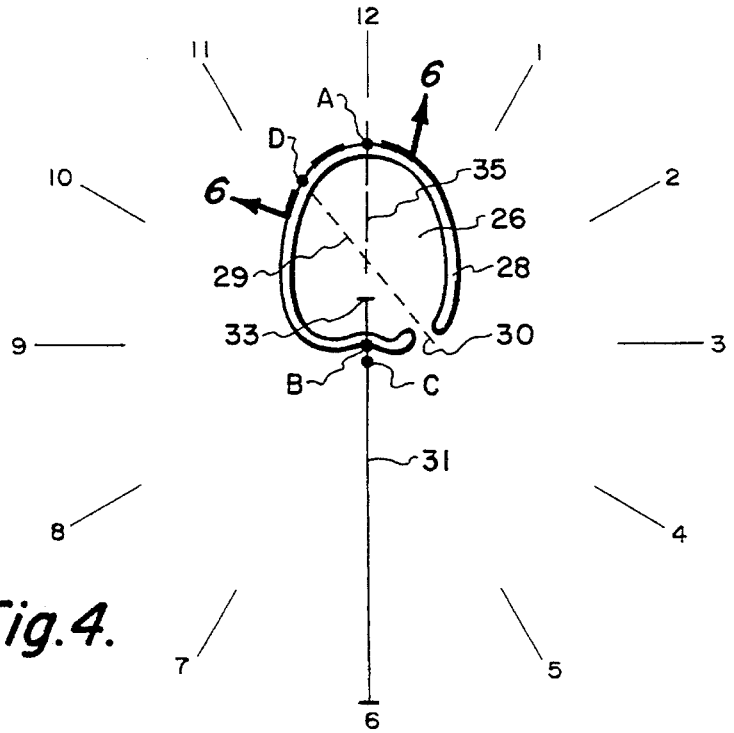
FIG. 4 is a schematic view of the opening apparatus in relation to the frangible seal with the handle of the opening apparatus in the recommended opening position shown in FIG. 2.
Figure 5:
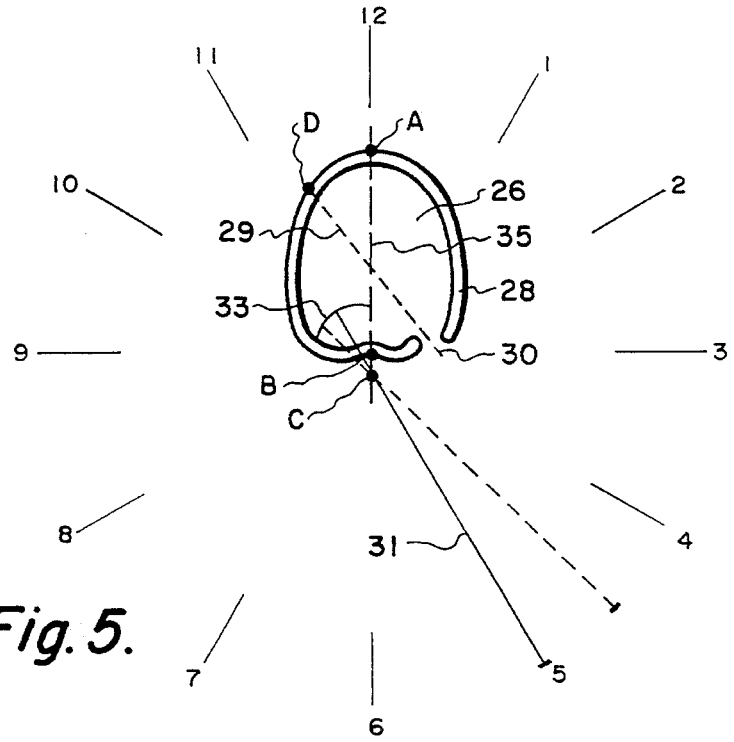
FIG. 5 is a schematic view similar to FIG. 4 with the handle in the storage position shown in FIG. 1.

The upward opening operation of the handle 38 is permitted by reason of the slot 46. It has been found in this invention that even if the handle 38 was located for some reason over adjacent the 4 o'clock position and the handle 38 is operated as previously described, that breaking of the frangible seal created by score line 28 will consistently occur because pressure from the lever 40 is applied away from the gap to close to the 9 to 11 o'clock position of frangible seal 28. In addition, the longitudinal axis line 31 of the handle 38 is still reasonably close to point D. It is important to note that the upward opening movement of the handle 38 at any position from 4 o'clock to 6 o'clock will result in breaking of the frangible seal produced by score line 28. The pressure applying point 33 of application of force of lever 40 should always be on the center axis 35 of the panel 26 or located in the half area of the panel 26 that also contains point D. This half area is to the left of center axis 35 in FIGS. 4 and 5. It has been found that when point 33 is applied in the half area of the panel 26 (right of axis 35) that doesn't contain point D, the frangible seal 28 will not always break.

If the gap 30 is located at the seven o'clock position for the score line 28, it is to be understood that the position of the handle 38 would have to be flipped assuming a reverse image. In other words, the initial storage position of the handle 38 must be located according to the location of the gap 30, as well as the position of the lever 40 during the opening operations.

The score line 28, with which the container opening apparatus of this invention is intended to be used, is of the design of score line 28 and fracture point D that is being manufactured and sold on a wide scale basis in conjunction with beverage containers. All of the known prior art beverage container opening apparatuses have not been designed in conjunction with the score line design and gap that is in conventional use. It is to be understood that if the score line design 28 were to be flopped, that is the gap 30 being located directly adjacent the 8 o'clock position rather than the 4 o'clock position, then the handle 38 would also have to be flopped in order to have consistent opening. This would place the pressure applying point 33 in the right half (referring to FIG. 4) of the panel 26. Also the fracture point D would be flopped and it would also be located in the right half of the panel 26 between 1 and 3 o'clock.

In the designing of the container opening apparatus of the present invention, great care has been taken to make it "inadvertently proof" as possible which means to insure opening of the frangible seal even if the handle 38 is not first moved to the 6 o'clock position. As previously mentioned, even though the user is specifically advised to move the handle 38 to align it with the 6 o'clock position in order to be assured of normal opening of the beverage container, field tests prove some users will attempt to open the beverage container by pivoting of the handle upward against the panel 26 directly from the storage position without any sideways movement. Marketers of the beverage containers which contain this type of beverage opening apparatus require continuous opening performance in the event that a user were to attempt to open a beverage container directly from the proposed storage position rather than the normal 6 o'clock position so that the frangible seal would be broken not just some of the time but all of the time. This 100% opening operation will occur following the teachings of the present invention.

What is claimed is:

1. In combination with a thin sheet material closure wall of a container, an access opening formed in said closure wall, said access opening normally closed by a panel, said panel being defined by a frangible seal formed in said closure wall at the periphery of said panel, said frangible seal having a forward point located at a 12 o'clock position, said frangible seal having a rearward point located at a 6 o'clock position, a pivot point located on said closure wall at said 6 o'clock position directly adjacent said frangible seal, said frangible seal comprising a score line which is totally enclosing except for a single gap, said gap located between a 4 o'clock and a 5 o'clock position, said gap being in alignment with said score line, an opening tab pivotally mounted at said pivot point, said opening tab being pivotable laterally from a storage position to a frangible seal breaking position, means mounted on said closure wall for causing said opening tab to be elevated to a raised position when moved laterally to said frangible seal breaking position, said opening tab having a forward end forming a lever, said lever to engage said panel during opening operation comprising manual pivoting of said opening tab in a plane substantially perpendicular to said closure wall causing said frangible seal to break and said panel to deflect and pivot at said gap producing a hinge, said break to initiate between the 10 and 12 o'clock position on said frangible seal, the improvement comprising:

said storage position being when said opening tab aligns approximately with said 5 o'clock position, said frangible seal breaking position being when said opening tab aligns with said 6 o'clock position; and said opening operation to consistently result in said frangible seal being broken with said opening tab being lifted from said storage position and also in said frangible seal breaking position and in any position therebetween.

2. The combination as defined in claim 1 wherein:

said means comprising a single protuberance, said opening tab to be movable onto said protuberance as said opening tab is moved from said storage position to said frangible seal breaking position producing said inclined position.

3. In combination with a thin sheet material closure wall of a container, an access opening formed in said closure wall, said access opening normally closed by a panel, said panel being defined by a frangible seal formed in said closure wall at the periphery of said panel, said frangible seal having a forward point located at a 12 o'clock position, said frangible seal having a rearward point located at a 6 o'clock position, a pivot point located on said closure wall at said 6 o'clock position directly adjacent said frangible seal, said frangible seal comprising a score line which is totally enclosing except for a single gap, said gap located between a 4 o'clock and a 5 o'clock position, an opening tab pivotally mounted at said pivot point, said opening tab being pivotable from a storage position to a frangible seal breaking position, means mounted on said closure wall for raising said opening tab to an inclined position when in said frangible seal breaking position, said opening tab having a forward end forming a lever, said lever to engage said panel during opening operation comprising manual pivoting of said opening tab in a plane substantially perpendicular to said closure wall and cause said frangible seal to break causing said panel to deflect and pivot at said gap producing a hinge, said break to initiate between the 10 and 12 o'clock position, the improvement comprising:

said storage position being when said opening tab aligns approximately with said 5 o'clock position, said frangible seal breaking position being when said opening tab aligns with said 6 o'clock position;.

said opening operation to consistently result in said frangible seal being broken with said opening tab being located in said storage position and also in said frangible seal breaking position and in any position therebetween;

said means comprising a single protuberance, said opening tab to be movable onto said protuberance as said opening tab is moved from said storage position to said frangible seal breaking position producing said inclined position; and said opening tab including an enlarged opening, said protuberance being totally located within the confines of said enlarged opening when said opening tab is in said storage position.

4. The combination as defined in claim 3 wherein:

said protuberance including a detent, said detent to be engaged by said opening tab when said opening tab is in said frangible seal breaking position thereby indicating to the user that said opening tab is in said frangible seal breaking position.

5. In combination with a thin sheet material closure wall of the container, an access opening formed in said closure wall, said access opening normally closed by a panel, said panel being defined by a frangible seal formed in said closure wall at a periphery of said panel, said frangible seal having a forward point located at a 12 o'clock position, said frangible seal having a rearward point located at a 6 o'clock position, an imaginary center axis connecting said 12 o'clock position and said 6 o'clock position dividing said panel into a pair of halves, a pivot point located on said closure wall at said 6 o'clock position directly adjacent said frangible seal, said frangible seal comprising a score line which is totally enclosing except for a single gap, said gap being in alignment with said score line, said gap located within one of said halves, an opening tab pivotally mounted at said pivot point, said opening tab having a forward end terminating in a lever which has a pressure applying point located directly adjacent said panel, said opening tab having a rearward end located exteriorly of said frangible seal, said opening tab being pivotable from a storage position to a frangible seal breaking position, means mounted on said closure wall for raising said opening tab to an inclined position when moved laterally in said frangible seal breaking position, said pressure applying point to engage said panel during opening operation comprising manual pivoting of said opening tab in a plane substantially perpendicular to said closure wall and cause said frangible seal to break causing said panel to deflect and pivot at said gap producing a hinge, the improvement comprising:

said pressure applying point located in said half that does not contain said gap; and said opening operation to result in said frangible seal being consistently broken with said opening tab located in said storage position and also in said frangible seal breaking position and in any position therebetween.

6. The combination as defined in claim 5 wherein:

said means comprising a single protuberance, said opening tab to be movable onto said protuberance as said opening tab is moved from said storage position to said frangible seal breaking position producing said inclined position.

7. The combination as defined in claim 5 wherein:

said frangible seal including an initial breaking point, said initial breaking point being located in the same half as said pressure applying point of said lever.

8. In combination with a thin sheet material closure wall of a container, an access opening formed in said closure wall, said access opening normally closed by a panel, said panel being defined by a frangible seal formed in said closure wall at the periphery of said panel, said frangible seal having a forward point located at a 12 o'clock position, said frangible seal having a rearward point located at a 6 o'clock position, a center axis connecting said 12 o'clock and said 6 o'clock position dividing said panel into a pair of halves, a pivot point located on said closure wall at said 6 o'clock position directly adjacent said frangible seal, said frangible seal comprising a score line which is totally enclosing except for a single gap, said gap located within one of said halves, an opening tab pivotally mounted at said pivot point, said opening tab having a forward end terminating in a lever which has a pressure applying point located directly adjacent said panel, said opening tab having a rearward end located exteriorly of said frangible seal, said opening tab being pivotable from a storage position to a frangible seal breaking position, means mounted on said closure wall for raising said opening tab to an inclined position when in said frangible seal breaking position, said pressure applying point to engage said panel during opening operation comprising manual pivoting of said opening tab in a plane substantially perpendicular to said closure wall and cause said frangible seal to break causing said panel to deflect and pivot at said gap producing a hinge, the improvement comprising:

said pressure applying point located in said half that does not contain said gap;

said opening operation to consistently result in said frangible seal being broken with said opening being located in said storage position and also in said frangible seal breaking position and in any position therebetween;

said means comprising a single protuberance, said opening tab to be movable onto said protuberance as said opening tab is moved from said storage position to said frangible seal breaking position producing said inclined position; and said rearward end of said opening tab including an enlarged opening, said protuberance being totally located within the confines of said enlarged opening when said opening tab is in said storage position thereby precisely defining said storage position.

9. The combination as defined in claim 8 wherein:

said protuberance including a detent, said detent to be engaged by said rearward end of said opening tab when said opening tab is in said frangible seal breaking position thereby indicating to the user that said opening tab is in said frangible seal breaking position.

* * * * *